US010500461B2

(12) United States Patent
Luo

(10) Patent No.: US 10,500,461 B2
(45) Date of Patent: Dec. 10, 2019

(54) FOLDABLE REBOUND NET FRAME

(71) Applicant: TRI-GREAT INTERNATIONAL LTD., Dongguan (CN)

(72) Inventor: Chunfang Luo, Dongguan (CN)

(73) Assignee: TRI-GREAT INTERNATIONAL LTD., Dongguan (CN)

( * ) Notice: Subject to any disclaimer, the term of this patent is extended or adjusted under 35 U.S.C. 154(b) by 0 days.

(21) Appl. No.: 16/211,822

(22) Filed: Dec. 6, 2018

(65) Prior Publication Data

US 2019/0176006 A1 Jun. 13, 2019

(30) Foreign Application Priority Data

Dec. 12, 2017 (CN) ..... 2017 2 1724290 U

(51) Int. Cl.
*A63B 63/00* (2006.01)
*A63B 69/00* (2006.01)

(52) U.S. Cl.
CPC ..... *A63B 63/00* (2013.01); *A63B 69/0097* (2013.01); *A63B 2063/001* (2013.01); *A63B 2210/50* (2013.01)

(58) Field of Classification Search
CPC ..... A63B 2210/50; A63B 63/005; A63B 69/0097; A63B 63/00; A63B 71/022
USPC ..... 273/395, 396, 398–402; 473/434, 435, 473/454
See application file for complete search history.

(56) References Cited

U.S. PATENT DOCUMENTS 3,427,026 A * 2/1969 Mahoney ..... A63B 69/0097 273/395
3,456,945 A * 7/1969 Epply ..... A63B 69/0097 473/435
4,239,235 A * 12/1980 Torres ..... A63B 69/0097 473/434
5,539,957 A * 7/1996 Schmidt ..... A63B 63/004 16/254
5,681,045 A * 10/1997 Liao ..... A63B 63/004 273/400
5,722,905 A * 3/1998 Bidelman ..... A63B 71/022 273/400
5,833,234 A * 11/1998 Vavala ..... A63B 69/0097 473/434
5,954,600 A * 9/1999 Gill ..... A63B 63/004 273/400

(Continued)

*Primary Examiner* — Mark S Graham
(74) *Attorney, Agent, or Firm* — Hemisphere Law, PLLC; Zhigang Ma

(57) ABSTRACT

The application relates to a foldable rebound net frame includes a surface frame and supporting stands. The surface frame includes a frame structure and a rebound net mounted on the frame structure, the frame structure comprises a plurality of supporting rods and connecting mechanisms, the plurality of supporting rods are connected in a head-to-tail manner by the connecting mechanisms, and two ends of each of the plurality of supporting rods are rotatably mounted on corresponding ones of the connecting mechanisms respectively. The supporting stands are adjustably mounted on corresponding ones of the plurality of supporting rods. The foldable rebound net frame of the disclosure has a simple structure and a low production cost, also has a small size and is convenient to carry in a folded state.

3 Claims, 3 Drawing Sheets

(56) References Cited

U.S. PATENT DOCUMENTS

| | | | | |
|---|---|---|---|---|
| 6,220,776 | B1 * | 4/2001 | Reeves | A63B 63/004 403/102 |
| 6,241,630 | B1 * | 6/2001 | Alberti | A63B 61/02 403/102 |
| 6,371,873 | B1 * | 4/2002 | Wang | A63B 63/004 273/407 |
| 7,850,576 | B2 * | 12/2010 | Sellke | A63B 63/004 273/407 |
| 8,657,521 | B2 * | 2/2014 | Reeves | A63B 63/004 403/293 |
| 9,821,206 | B2 * | 11/2017 | Mosher | A63B 69/0002 |
| 2003/0236139 | A1 * | 12/2003 | Jensen | A63B 69/0002 473/434 |
| 2008/0067751 | A1 * | 3/2008 | Hunt | A63B 63/00 273/396 |
| 2015/0306483 | A1 * | 10/2015 | Dorsett | A63B 69/0097 473/435 |

* cited by examiner

FOLDABLE REBOUND NET FRAME

FIELD OF THE DISCLOSURE

The disclosure relates to the field of net frame technologies, and more particularly to a foldable rebound net frame for balls.

BACKGROUND

Existing large-size net frames for balls are generally difficult to install, and conventional folding structures thereof are very complicate and inconvenient to fold. There are too many folding joints in the conventional folding structures, resulting in a high cost in manufacturing and inconvenience in production and practical use.

SUMMARY

The disclosure provides a net frame, particularly a foldable rebound net frame for balls, to solve the above mentioned problem.

To achieve the above object, technical solutions of the disclosure are provided as follows.

A foldable rebound net frame includes a surface frame and supporting stands. The surface frame includes a frame structure and a rebound net mounted on the frame structure, the frame structure comprises a plurality of supporting rods and connecting mechanisms, the plurality of supporting rods are connected in a head-to-tail manner by the connecting mechanisms, and two ends of each of the plurality of supporting rods are rotatably mounted on corresponding ones of the connecting mechanisms respectively. The supporting stands are adjustably mounted on corresponding ones of the plurality of supporting rods.

In an embodiment, the connecting mechanisms include first folding racks and second folding racks; the first folding racks and the second folding racks are spaced apart from one another and alternately disposed at respective corners of the surface frame, so as to realize the connection between every adjacent two of the plurality of supporting rods.

In an embodiment, each of the first folding racks and the second folding racks is a hollow U-shaped body with one opening end, two opposite sidewalls of each of the first folding racks each are provided with clamping slots being symmetrical; a first one of the two ends of each of the plurality of supporting rods is provided with a mounting portion, an adjusting spring is disposed in the mounting portion, the first end of the supporting rod is rotatably inserted into one of the first folding racks through the mounting portion, and the other one of the two ends of the supporting rod is rotatably mounted in one of the second folding racks through a screw.

In an embodiment, the mounting portion is rotatably mounted in one of the first folding racks through another screw which is adjustably engaged with one of the clamping slots.

In an embodiment, the supporting stands symmetrically disposed on two opposite sides of the surface frame, each of the supporting stands comprises a connecting block and a supporting beam rotatably mounted on the connecting block, and the connecting block is adjustably mounted on one of the plurality of the supporting rods The disclosure has the beneficial effects that: simplifying the folding structure of the conventional net frame, adopting folding racks each of which is disposed between two adjacent supporting rods, and being folded conveniently. The space is fully used to realize a three-dimensional folding manner, and the folded product has a small size and is very easy to carry away. The foldable rebound net frame of the disclosure has a simple structure, a low production cost, a convenient performance and a strong practicality.

BRIEF DESCRIPTION OF THE DRAWINGS

In order to more clearly illustrate technical solutions of embodiments of the disclosure, drawings used in the embodiments will be briefly introduced below. Apparently, the drawings in the description below are merely some embodiments of the disclosure, a person skilled in the art can obtain other drawings according to these drawings without creative efforts.

Figure 1:
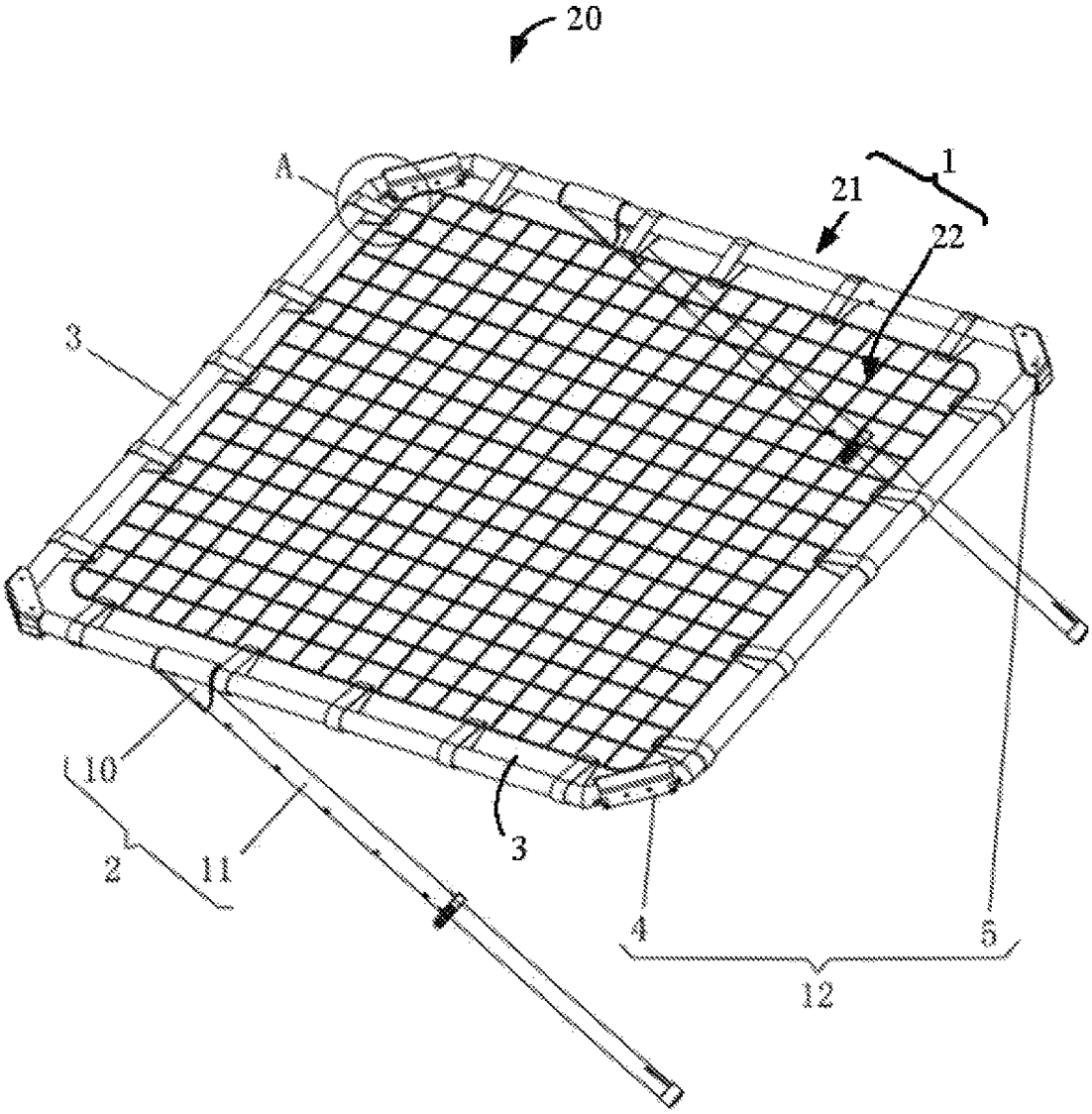
FIG. 1 is a schematic structural view of a foldable rebound net frame, according to an embodiment of the disclosure.

Descriptions of reference numerals: 1—surface frame; 2—supporting stand; 3—supporting rod; 4—first folding rack; 5—second folding rack; 6—clamping slot; 7—mounting portion; 8—adjustable spring; 9—screw; 10—connecting block; 11—supporting beam; 12—connecting mechanism; 20—foldable rebound net frame; 21—frame structure; 22—rebound net.

DETAILED DESCRIPTION OF PREFERRED EMBODIMENTS

The specific embodiments of the disclosure are described in detail below with reference to the accompanying drawings.

Figure 2:
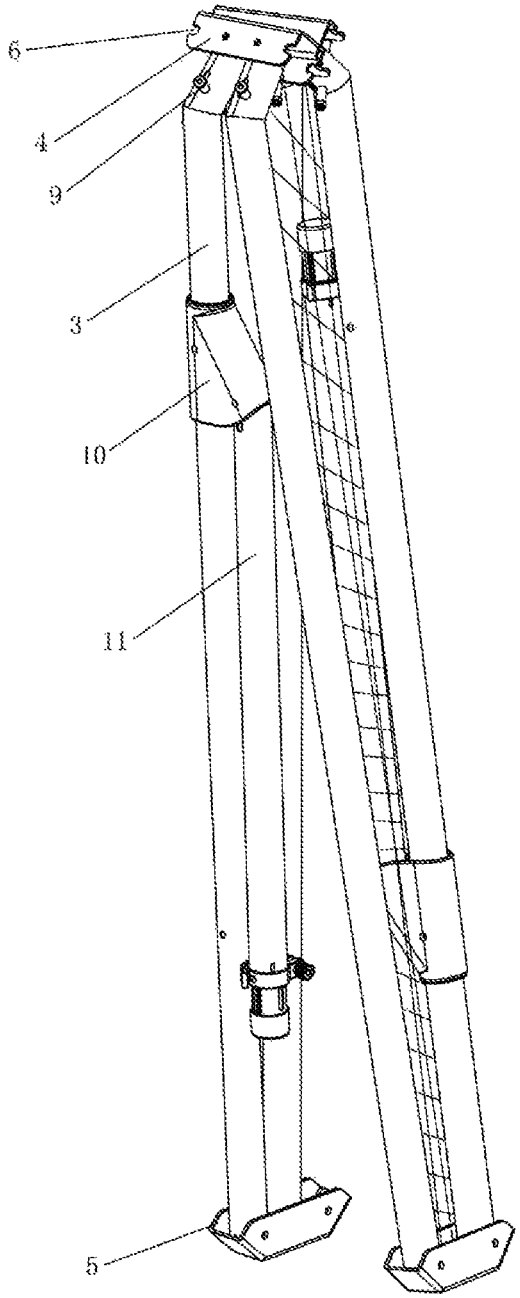
FIG. 2 is a schematic structural view of a foldable rebound net frame in a folded state, according to an embodiment of the disclosure.
Figure 3:
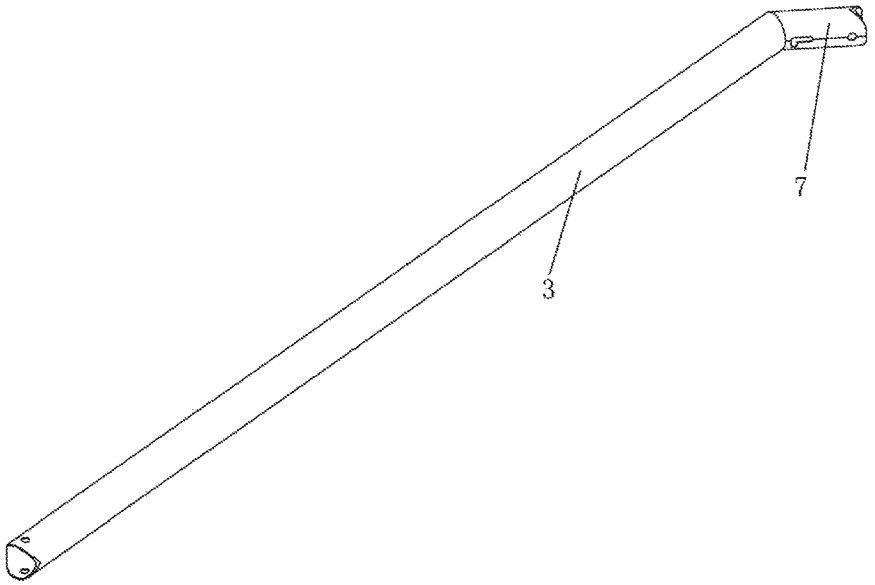
FIG. 3 is a schematic structural view of a supporting rod, according to an embodiment of the disclosure.
Figure 4:
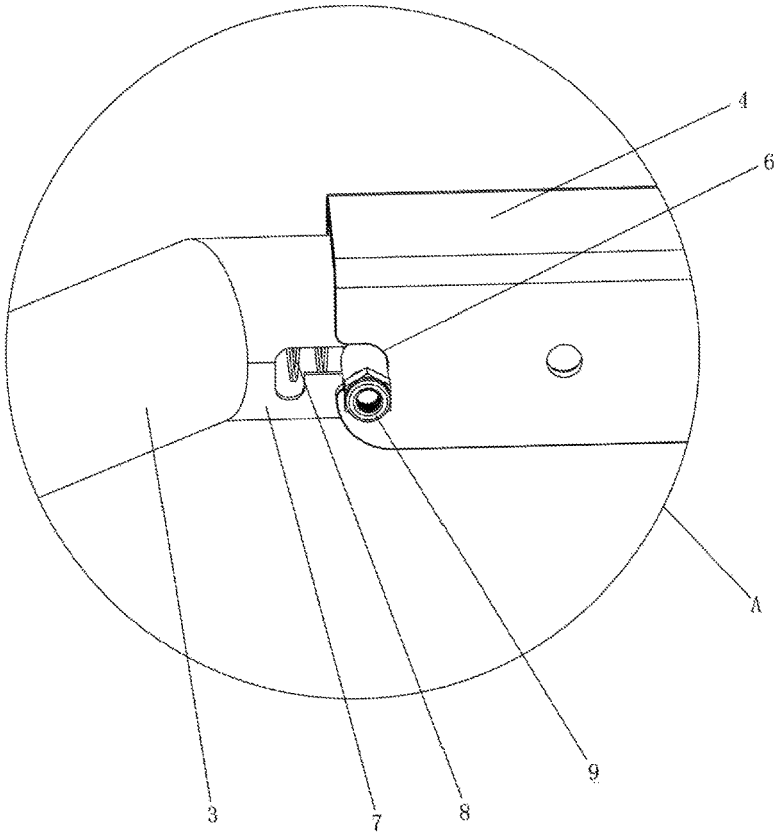
FIG. 4 is an enlarged view of a portion A of FIG. 1.

As shown in FIGS. 1-4, a foldable rebound net frame 20 includes a plane frame 1 and supporting stands 2. The surface frame 1 includes a frame structure 21 and a rebound net 22 mounted on the frame structure 21, wherein the frame structure 21 includes a plurality of supporting rods 3 and connecting mechanisms 12, the plurality of supporting rods 3 are connected in a head-to-tail manner by the connecting mechanisms 12, and two ends of each of the plurality of supporting, rods 3 are rotatably mounted on corresponding ones of the connecting mechanisms 12 respectively. The supporting stands 2 are adjustably mounted on corresponding ones of the plurality of supporting rods 3.

The connecting mechanism 12 includes first folding racks 4 and second folding racks 5, the first folding racks 4 and the second folding racks 5 are spaced apart from one another and alternately disposed at respective corners of the surface frame 1, so as to realize the connection between every adjacent two of the plurality of supporting rods 3.

Each of the first folding racks 4 and the second folding racks 5 is a hollow U-shaped body with one opening end, two opposite sidewalls of each of the first folding racks 4 each are provided with clamping slots 6 being symmetrical. A first one of the two ends of each of the plurality of supporting rods 3 is provided with a mounting portion 7, at least one adjusting spring 8 is disposed in the mounting portion 7, the first end of the supporting rod 3 is rotatably inserted into one corresponding first folding rack 4 through the mounting portion 7, the other one of the two ends of the supporting rod 3 is rotatably mounted in one corresponding second folding rack 5 through a screw 9.

The mounting portion 7 is rotatably mounted in the corresponding first folding rack 4 through another screw 9, which is adjustably engaged with corresponding clamping slots 6.

The supporting stands 2 may be two, symmetrically disposed on two opposite sides of the surface frame 1, each of the supporting stands 2 includes a connecting block 10 and a supporting beam 11 rotatably mounted on the connecting block 10, the connecting block 10 is adjustably mounted on one of the plurality of the supporting rod 3.

The above description is just a preferred embodiment of the disclosure, and is not intended to limit the technical scope of the disclosure. Skilled person in the art may make some modifications and substitutions under the teaching of the technical solution of the disclosure. These modifications or substitutions, which are based on the essences of the technical solution of disclosure, are still within the scope of the technical solutions of the embodiments of the disclosure.

What is claimed is:

1. A foldable rebound net frame, comprising a surface frame and supporting stands;

wherein the surface frame comprises a frame structure and a rebound net mounted on the frame structure, the frame structure comprises a plurality of supporting rods and connecting mechanisms, the plurality of supporting rods are connected in a head-to-tail manner by the connecting mechanisms, and two ends of each of the plurality of supporting rods are rotatably mounted on corresponding ones of the connecting mechanisms respectively;

wherein the supporting stands are adjustably mounted on corresponding ones of the plurality of supporting rods;

wherein the connecting mechanisms comprise first folding racks and second folding racks; the first folding racks and the second folding racks are spaced apart from one another and alternately disposed at respective corners of the surface frame, so as to realize the connection between every adjacent two of the plurality of supporting rods;

wherein each of the first folding racks and the second folding racks is a hollow U-shaped body with one opening end, two opposite sidewalls of each of the first folding racks each are provided with clamping slots being symmetrical; a first one of the two ends of each of the plurality of supporting rods is provided with a mounting portion, an adjusting spring is disposed in the mounting portion, the first end of the supporting rod is rotatably inserted into one of the first folding racks through the mounting portion, and the other one of the two ends of the supporting rod is rotatably mounted in one of the second folding racks through a screw.

2. The foldable rebound net frame according to claim 1, wherein the mounting portion is rotatably mounted in one of the first folding racks through another screw which is adjustably engaged with one of the clamping slots.

3. The foldable rebound net frame according to claim 1, wherein the supporting stands symmetrically disposed on two opposite sides of the surface frame, each of the supporting stands comprises a connecting block and a supporting beam rotatably mounted on the connecting block, and the connecting block is adjustably mounted on one of the plurality of the supporting rods.

* * * * *